US005217220A

United States Patent [19]

Carlson et al.

[11] Patent Number: 5,217,220

[45] Date of Patent: Jun. 8, 1993

[54] DIVERTER FOR A PRINTING PRESS

[76] Inventors: Herbert L. Carlson, 2923 W. Argyle, Chicago, Ill. 60625; Jozef W. Niemiro, 7933 Pine Ct., Darien, Ill. 60559

[21] Appl. No.: 746,846

[22] Filed: Aug. 19, 1991

[51] Int. Cl.[5] ..... B65H 29/54

[52] U.S. Cl. ..... 271/303; 271/308; 271/311; 271/82; 271/900; 493/416

[58] Field of Search ..... 271/279, 280, 289, 303, 271/306-308, 312, 314, 82, 900; 493/405, 416; 101/278, 279

[56] References Cited

U.S. PATENT DOCUMENTS

| | | | |
|---|---|---|---|
| 1,741,848 | 12/1929 | Kelly | 101/278 |
| 2,844,372 | 7/1958 | Liebenow et al. | 271/312 |
| 3,206,191 | 9/1965 | Hantscho | 271/303 |
| 3,459,421 | 8/1969 | Motter | 271/82 |
| 4,381,705 | 5/1983 | Roes et al. | 271/303 |
| 4,405,126 | 9/1983 | Frye et al. | 271/279 |
| 4,570,801 | 2/1986 | Brannen | 271/303 |
| 4,627,609 | 12/1986 | Höfer | 271/82 |
| 4,720,091 | 1/1988 | Kobler | 271/280 |
| 4,918,482 | 4/1990 | Ogura | 271/280 |
| 4,997,180 | 3/1991 | Ishii et al. | 271/308 |
| 5,163,673 | 11/1992 | Heppenstiel | 271/284 |

FOREIGN PATENT DOCUMENTS

| | | | |
|---|---|---|---|
| 1142789 | 1/1963 | Fed. Rep. of Germany | 271/280 |
| 2724387 | 12/1978 | Fed. Rep. of Germany | 271/303 |
| 2939941 | 4/1980 | Fed. Rep. of Germany | 271/289 |
| 349272 | 9/1937 | Italy | 101/279 |
| 167166 | 7/1987 | Japan | 271/280 |
| 215361 | 4/1924 | United Kingdom | 101/279 |

*Primary Examiner*—Robert P. Olszewski
*Assistant Examiner*—Steven M. Reiss

[57] ABSTRACT

A diverter (10) for a printing press having a cylinder (14) for sequentially carrying printed matter (22), a device (16) for rotating the cylinder (14) a device (42) for passing the printed matter (22) along a first usual path (32) when the printed matter (22) is in a proper arrangement, and for diverting the printed matter (22) along a second different path (54) when the printed matter (22) becomes jammed along the first path (32).

12 Claims, 3 Drawing Sheets

DIVERTER FOR A PRINTING PRESS

BACKGROUND OF THE INVENTION

The present invention relates to diverters for a printing press.

In the past, signatures have been sequentially printed and passed to a suitable folder in a printing press. However, on occasion the signatures may build up and become jammed in the folder or on a path to the folder. The jam may form a large number of signatures in the jam before the press may be turned off. Such jammed signatures may cause considerable damage to the folder, and may require considerable down time of the press in order to remove the jam of signatures from the press, thus causing inefficiency in the press.

SUMMARY OF THE INVENTION

A principal feature of the present invention is the provision of a diverter for a printing press.

The diverter of the present invention comprises, a cylinder for sequentially carrying printed matter, means for rotating the cylinder, and means for passing the printed matter along a first usual path from the cylinder.

A feature of the present invention is that the printed matter is passed along the first path when the printed matter is in a proper arrangement.

Another feature of the invention is the provision of means for diverting the printed matter along a second different path when the printed matter becomes jammed along the first path.

Thus, a feature of the invention is that the diverter detects the formation of a jam along the first path.

Another feature of the invention is that the diverter minimizes the jam along the first path.

Still another feature of the invention is that the printed matter is passed to a ¼ folder along the first path.

Yet another feature of the invention is that the diverter minimizes the possibility of damage to the ¼ folder.

Another feature of the invention is that the diverter minimizes the down time of the press to remove the jam.

Thus, a feature of the invention is that the diverter improves the efficiency of the press.

Further features will become more fully apparent in the following description of the embodiments of the invention and from the appended claims.

DESCRIPTION OF THE PREFERRED EMBODIMENTS

Figure 1:
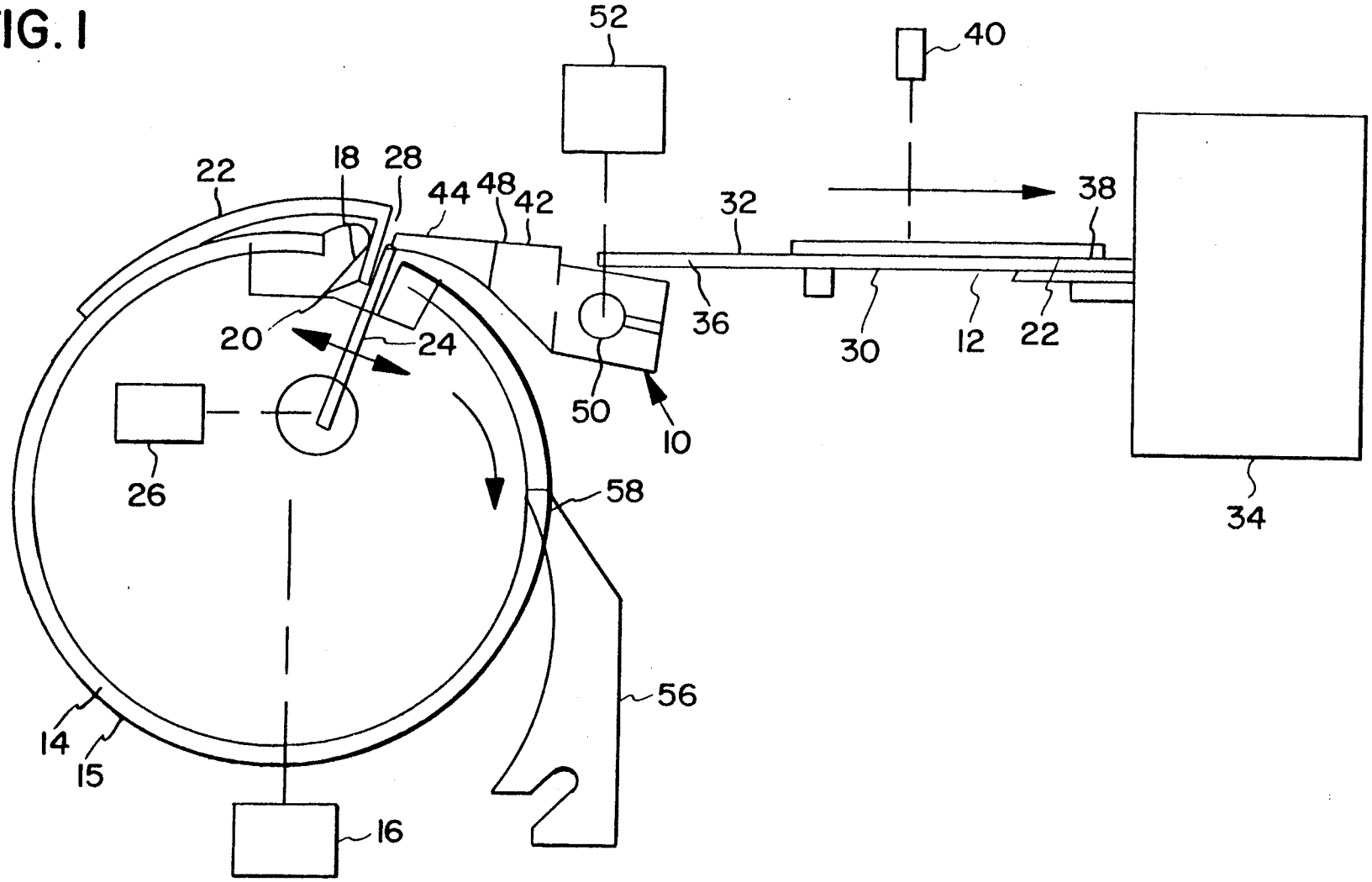
FIG. 1 is a side elevational view of a diverter for a printing press of the present invention with signatures being directed along a first usual path.

Referring now to FIG. 1, there is shown a diverter generally designated 10 for a printing press 12. The press 12 has a rotatable cylinder 14, and a suitable device 16, such as a motor, for rotating the cylinder 14. The cylinder 14 has a recess 18 for receiving an end portion 20 of printed matter or signatures 22, with the end portion 20 of the signatures 22 being retained in the recess 18 by a movable jaw 24, with the jaw 24 being movable by a suitable device 26, such as a motor or cylinder. The jaw 24 is movable between a first position grasping the signatures 22 in the recess 18, and a second position releasing the signatures 22 in the recess 18. The signatures 22 are grasped by the jaw 24 until they reach a rotatable position 28 where they are released by the jaw 24.

The press 12 has a plate 30 for passing the signatures 22 along a first path 32 towards a suitable device 34 in the press 12, such as a ¼ folder in the press 12, with one end 36 of the plate 30 being located adjacent the cylinder 14, and the other end 38 of the plate 30 being located adjacent the ¼ folder 34. The press 12 has a suitable sensor 40 located above the plate 30 for detecting a jam of signatures in the ¼ folder 34 or along the plate 30 with a signal from the sensor 40 being received by a suitable Central Processing Unit (CPU) which may have a randomly addressable memory (RAM) in addition to a read only memory (ROM) associated with the CPU.

Figure 2:
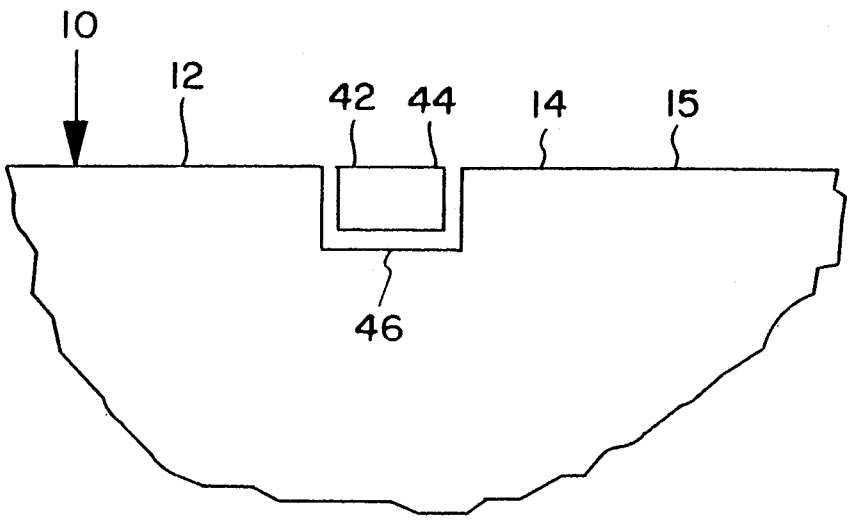
FIG. 2 is a fragmentary sectional view of a stripper finger associated with a cylinder of the present invention.

The diverter 10 has a first movable stripper member 42 located intermediate the cylinder 14 and the plate 30. The stripper member 42 has a stripper finger 44 received in a notch 46 of the cylinder 14, as shown in FIG. 2, in order to remove the signatures 22 from the cylinder 14 as they are released by the jaw 24, and direct the signatures 22 along the upper surface 48 of the stripper member 42 along the first path 32 of the plate 30 to the ¼ stripper 34 in a usual condition of the press 12.

Figure 3:
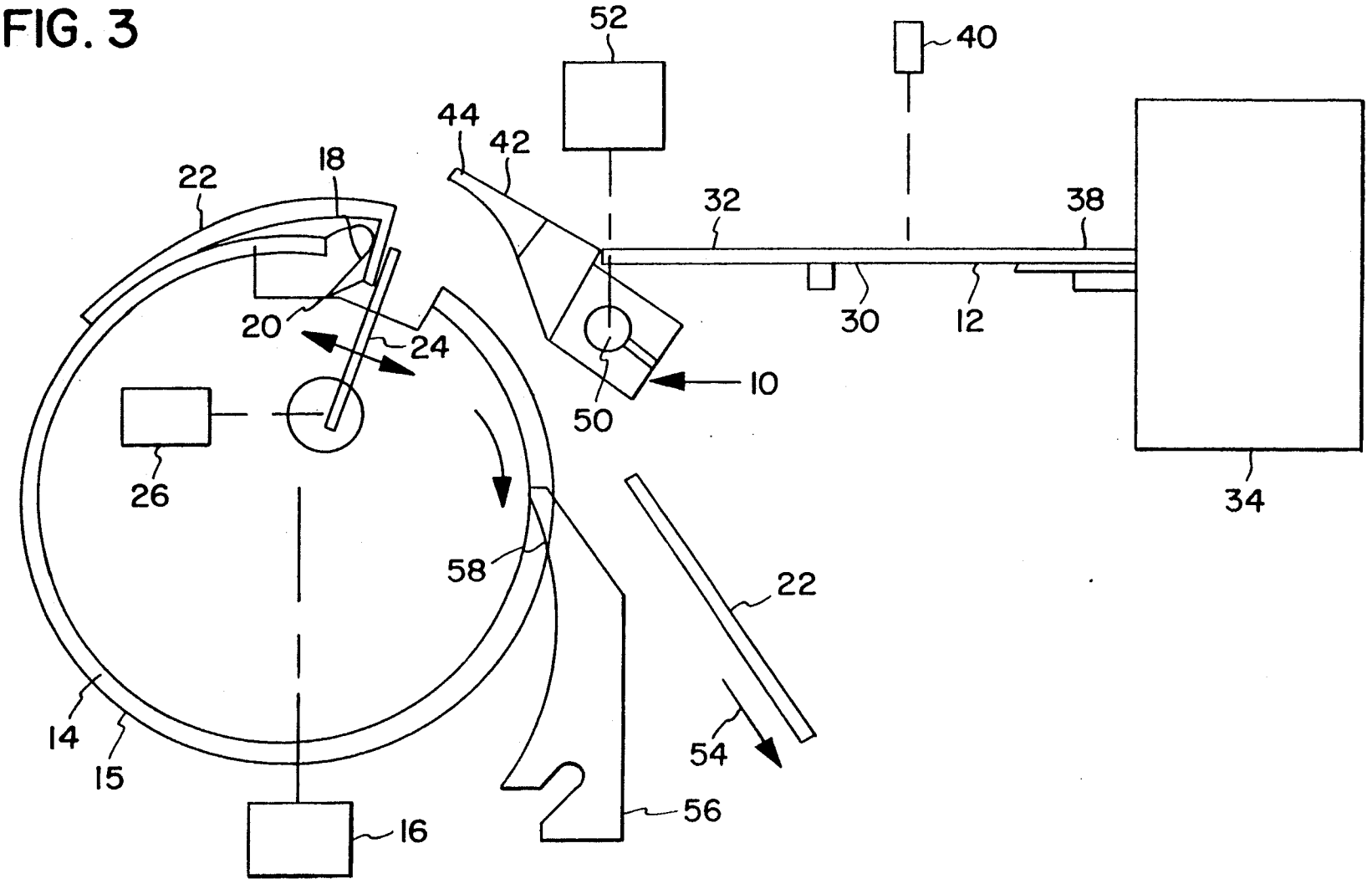
FIG. 3 is a side elevational view of the diverter directing signatures along a second diverted path.

As shown in FIG. 1, the stripper member 42 is rotatably mounted on a shaft 50 which may be rotated between first and second positions by a suitable device 52, such as a motor. When the sensor 40 detects a jam of the signatures 22 along the first path 32, the stripper member 42 is rotated to a second position, as controlled by the CPU, located away from an outer surface 15 of the cylinder 14, as shown in FIG. 3. In this configuration, the signatures 22 are permitted to pass beneath the stripper member 42 along a second diverted path 54 spaced beneath the plate 30 defining the first path 32. The press 12 has a second stationary stripper member 56 having a tongue 58 to remove the signatures 22 from the cylinder 1 along the second diverted path 54, thus directing the signatures 22 away from the 1/4 folder 34.

Thus, The stripper member 42 is movable between a first position adjacent the cylinder 14 for directing the signatures 22 along a first usual path 32 to the ¼ folder 34, and a second position directing the signatures 22 along a diverted path 54, thus directing the signatures 22 away from the ¼ folder in the case of a jam of the signatures 22 in the ¼ folder or along the first path 32 of the plate 30. In this manner, the diverter 10 detects a jam of the signatures 22 along the first path 32, and directs the signatures 22 at this time along the second path 54 in the event of a jam of the signatures 22 along the first path 32. Thus, the signatures 22 are prevented from passing to the ¼ folder in the event of a jam in order to minimize the possibility of damage to the ¼ folder due to the jam, and also minimizes the down time of the press required to clear out the jam of signatures 22 from the press 12. In this manner, the diverter 10 makes the press 12 significantly more efficient.

The foregoing detailed description has been given for clearness of understanding only, and no unnecessary limitations should be understood therefrom as modifications will be obvious to those skilled in the art.

What is claimed is:

1. A diverter for a printing press, comprising:

a cylinder for sequentially carrying printed matter;

means for rotating the cylinder;

means for passing the printed matter from the cylinder along a first usual path when the printed matter is in a proper arrangement;

means for sensing a jam of the printed material along the first path; and means responsive to the sensing means, detection of a jam for passing the printed matter along a second different path to prevent passage of the printed material along the first path, wherein the passing means comprises a stripper member having a stripper finger to remove the printed matter from the cylinder and direct the printed matter along the first path.

2. The diverter of claim 1 including means for grasping the printed matter on said cylinder, and for releasing the printed matter along the first path.

3. The diverter of claim 1 wherein the passing means directs the printed matter to a ¼ folder.

4. A diverter for a printing press, comprising:

a cylinder having means for grasping and carrying a signature;

means for rotating the cylinder;

a plate defining a first path of the signatures to a folder;

a sensor for detecting a jam of the signatures along the first path;

a stripper member adjacent an outer surface of the cylinder; and means responsive to the sensor for moving the stripper member between a first usual position adjacent the cylinder for removing the signatures from the cylinder and passing the signatures to the plate along the first path, and a second position spaced from the cylinder for passing the signatures along a second diverted path below the plate when the plate is jammed with signatures.

5. The diverter of claim 4 wherein the cylinder includes means for releasably grasping the signatures.

6. The diverter of claim 5 including means for removing the signatures from the cylinder along the first and second paths.

7. A diverter for a printing press, comprising:

a cylinder for sequentially carrying printed matter;

means for rotating the cylinder;

means for passing the printed matter from the cylinder along a first usual path when the printed matter is in a proper arrangement;

means for sensing a jam of the printed material along the first path; and means responsive to the sensing mans, detection of a jam for passing the printed matter along a second different path, wherein the diverting means comprises a stripper member, and means for moving the stripper member between a first usual position with the stripper member removing the printed matter from the cylinder and passing the printed matter along the first usual path, and a second position spaced away from the cylinder to permit the printed matter to pass along the second diverted path away from the first path.

8. A diverter for a printing press, comprising:

a cylinder for sequentially carrying printed matter;

means for rotating the cylinder;

means for passing the printed matter from the cylinder along a first usual path when the printed matter is in a proper arrangement;

means for sensing a jam of the printed material along the first path; and means responsive to the sensing means, detection of a jam for passing the printed matter along a second different path, wherein the cylinder includes a recess in an outer surface of the cylinder, and a jaw for clamping the printed matter in the recess.

9. A diverter for a printing press, comprising:

a cylinder for sequentially carrying printed matter;

means for rotating the cylinder;

means for passing the printed matter from the cylinder along a first usual path when the printed matter is in a proper arrangement;

means for sensing a jam of the printed material along the first path; and means responsive to the sensing means, detection of a jam for passing the printed matter along a second different path, including means for removing the printed matter from the cylinder along the second diverted path.

10. The diverter of claim 9 wherein the removing means comprises a stripper member positioned adjacent the cylinder 11. A diverter for a printing press, comprising:

a cylinder for sequentially carrying printed matter;

means for rotating the cylinder;

means for passing the printed matter from the cylinder along a first usual path when the printed matter is in a proper arrangement;

means for sensing a jam of the printed material along the first path; and means responsive to the sensing means, detection of a jam for passing the printed matter along a second different path, including means for removing the printed matter from the cylinder for passage along the first path.

12. The diverter of claim 11 wherein the removing means comprises a stripper member located adjacent the cylinder.

* * * * *